US007182236B1

(12) United States Patent
Wen

(10) Patent No.: US 7,182,236 B1
(45) Date of Patent: Feb. 27, 2007

(54) BRAKING MECHANISM FOR NAIL DRIVER

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/284,966

(22) Filed: Nov. 23, 2005

(51) Int. Cl.
*B25C 1/04* (2006.01)

(52) U.S. Cl. ..... 227/8; 227/120

(58) Field of Classification Search ..... 227/8, 227/120, 136, 130, 156
See application file for complete search history.

(56) References Cited

U.S. PATENT DOCUMENTS

| | | | | |
|---|---|---|---|---|
| 5,180,091 | A * | 1/1993 | Ota | 227/8 |
| 5,593,079 | A * | 1/1997 | Mukoyama et al. | 227/8 |
| 6,056,181 | A * | 5/2000 | Chuang | 227/8 |
| 6,149,046 | A * | 11/2000 | Ho et al. | 227/8 |
| 6,199,739 | B1 * | 3/2001 | Mukoyama et al. | 227/8 |
| 6,264,085 | B1 * | 7/2001 | Ho et al. | 227/8 |
| 6,592,014 | B2 * | 7/2003 | Smolinski | 227/8 |
| 6,772,931 | B2 * | 8/2004 | Miller et al. | 227/120 |
| 6,913,179 | B1 * | 7/2005 | Chen | 227/8 |
| 6,966,477 | B1 * | 11/2005 | Chien-Kuo et al. | 227/8 |
| 7,028,875 | B1 * | 4/2006 | Beville et al. | 227/8 |
| 7,032,794 | B1 * | 4/2006 | Hung et al. | 227/8 |
| 7,059,507 | B2 * | 6/2006 | Almeras et al. | 227/8 |

FOREIGN PATENT DOCUMENTS

| | | |
|---|---|---|
| TW | 321044 | 11/1997 |
| TW | 328255 | 3/1998 |
| TW | 576286 | 2/2004 |

* cited by examiner

*Primary Examiner*—Scott A. Smith

(57) ABSTRACT

A nail driver includes a braking unit and a resilient element. The braking unit has a protrusion and is pushed by the resilient element. The braking unit is abutted to a nail pusher of the nail driver to push nails together with the nail pusher in a nail cartridge of the nail driver. When there is no more nail left, the braking unit is pushed to block in the moving path of a securing slide rod of the nail driver so that the nail drive cannot be actuated until the nails are reloaded.

9 Claims, 11 Drawing Sheets

BRAKING MECHANISM FOR NAIL DRIVER

BACKGROUND OF THE INVENTION

The present invention relates to a braking mechanism for a nail driver, more particularly to a braking mechanism to restrain the movement of a securing slide rod when a nail driver runs out of nails.

Conventional braking mechanism for a nail driver including Taiwan patent publications no. 328255, 321044 and 576286 disclose a braking unit installed to a nail pusher or a securing slide rod of the nail driver so that the braking unit can restrain the movement of the securing slide rod when no more nail exists in the nail cartridge. However, the conventional braking units cannot provide secure restrain so that the securing slide rod is easily released to cause failure of the braking mechanism.

Therefore, the convention braking mechanism exists drawbacks to be improved.

BRIEF SUMMARY OF THE INVENTION

The present invention is to provide a reliable braking mechanism for a nail driver so that a securing slide rod can be securely restrained to ensure the nail driver will not be actuated when the nail driver runs out of nails.

Accordingly, the nail driver of the present invention includes a guiding plate, a securing slide rod, a nail cartridge, a braking unit and a resilient member. The guiding plate includes a punch channel. The securing slide rod includes a contact section, and is capable of slidably moving with respect to the guiding plate. The nail cartridge is mounted to the guiding plate, and includes a nail pusher and a spring for pushing the nail pusher to press nails loaded in the nail cartridge toward the punch channel. The braking unit is mounted on the nail pusher, and including a protrusion to contact to last nail of the loaded nails. The resilient member is contacted to the braking unit for pushing the braking unit to block in a moving path of the contact section when the last nail is gone.

Various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
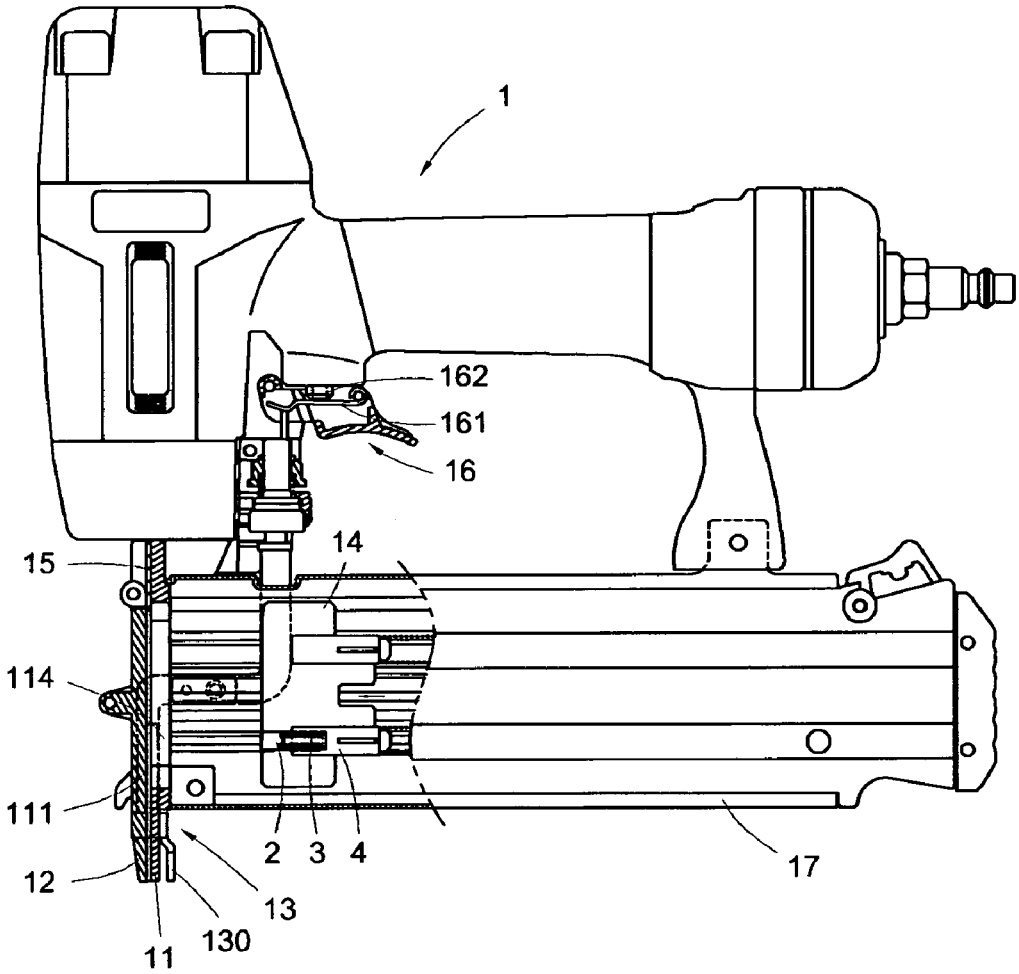
FIG. 1 is a front view of a nail driver according the first preferred embodiment of the present invention.
Figure 2:
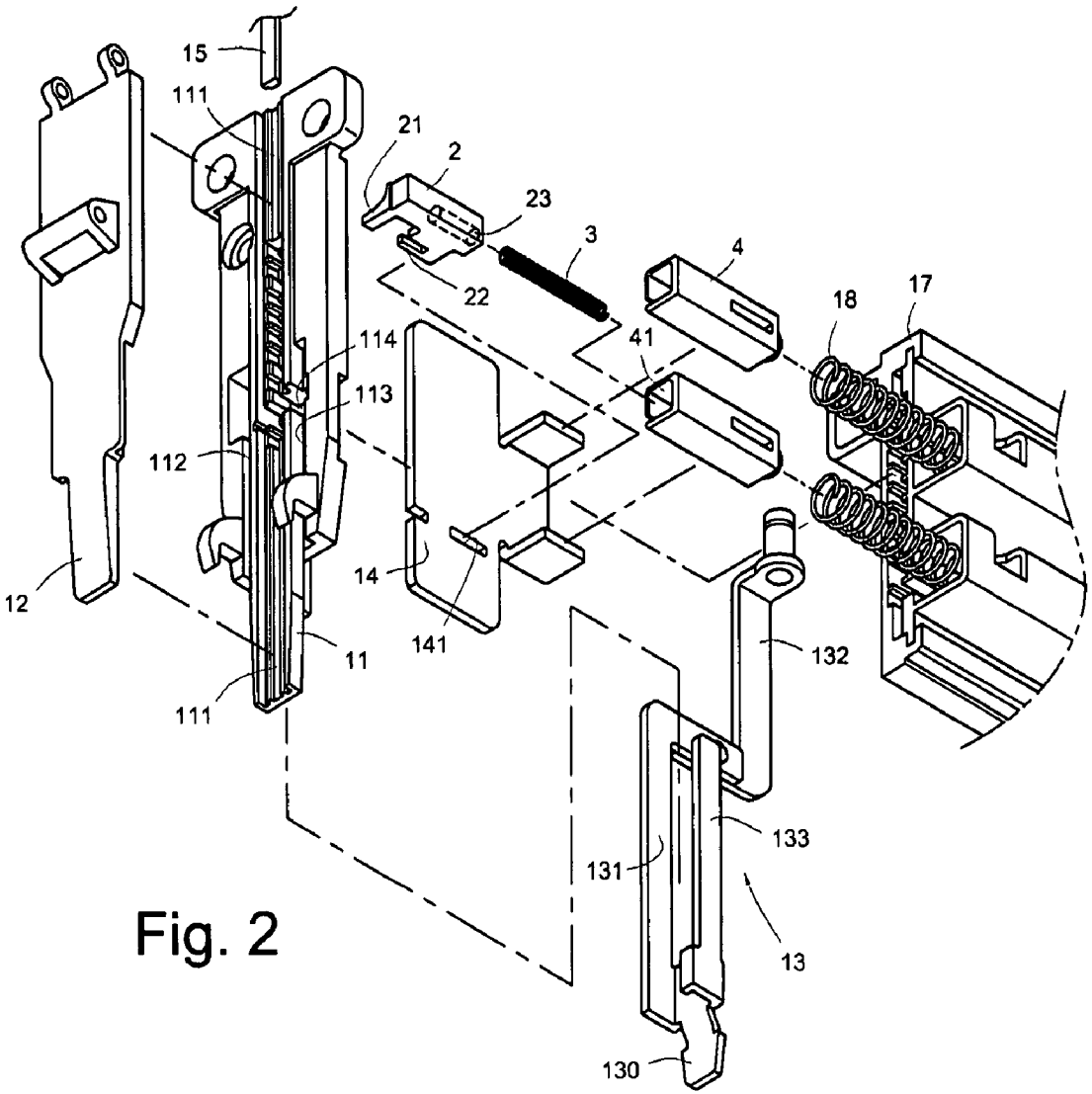
FIG. 2 is an exploded perspective view of nail driver, showing that the nail pusher is combined with the braking unit, and the securing slide rod is slidably mounted to the guiding plate.
Figure 3:
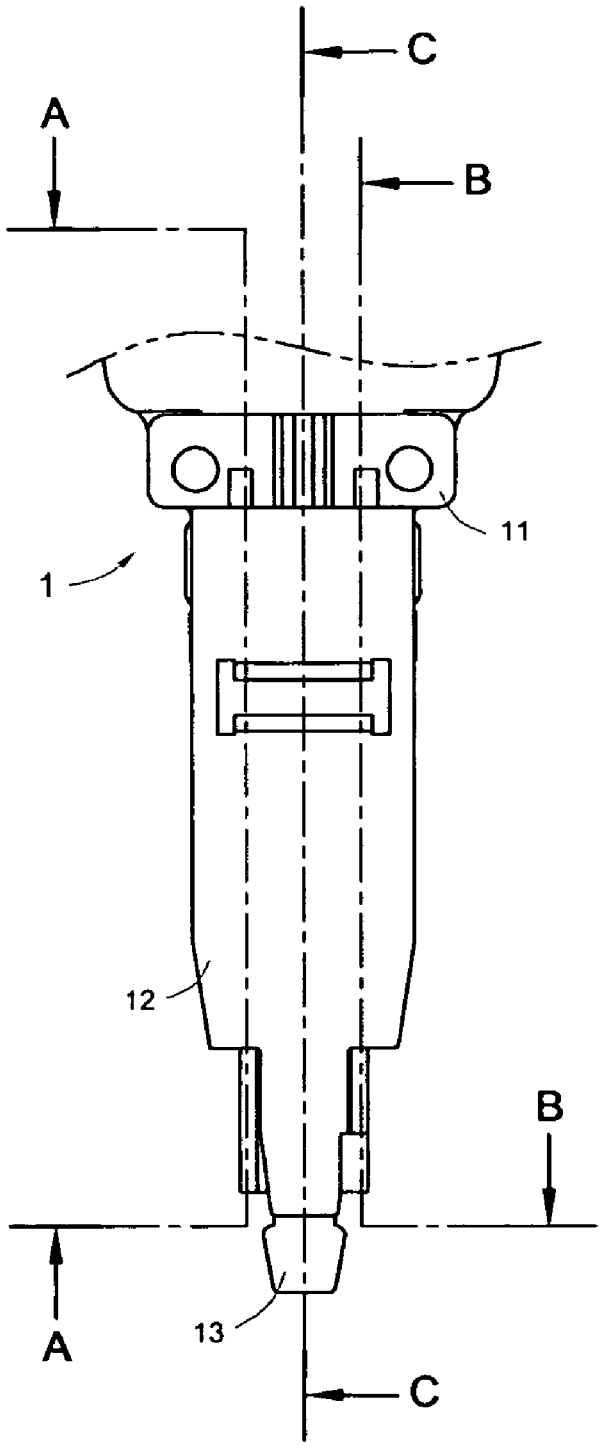
FIG. 3 is a local view facing to the guiding plate covered with the lid.

Referring to FIGS. 1~10, according to the first preferred embodiment of the present invention, a nail driver 1 performing T-shaped nails includes a nail pusher 14 moveably installed in a nail cartridge 17 and a braking unit 2 and an resilient element 3 mounted on the nail pusher 14 (as shown in FIG. 2). A securing slide rod 13 is mounted to a guiding plate 11 of the nail driver 1. The guiding plate 11 includes a punch channel 111, a guiding portion 112 and a groove 113 connected to the punch channel 111 through a passage 114 (as shown from FIGS. 2 to 5). A punch rod 15 of the nail driver 1 is slidably mounted in the punch channel 111, and a lid 12 is covered on the guiding plate 11 (as shown in FIG. 3).

Figure 4:
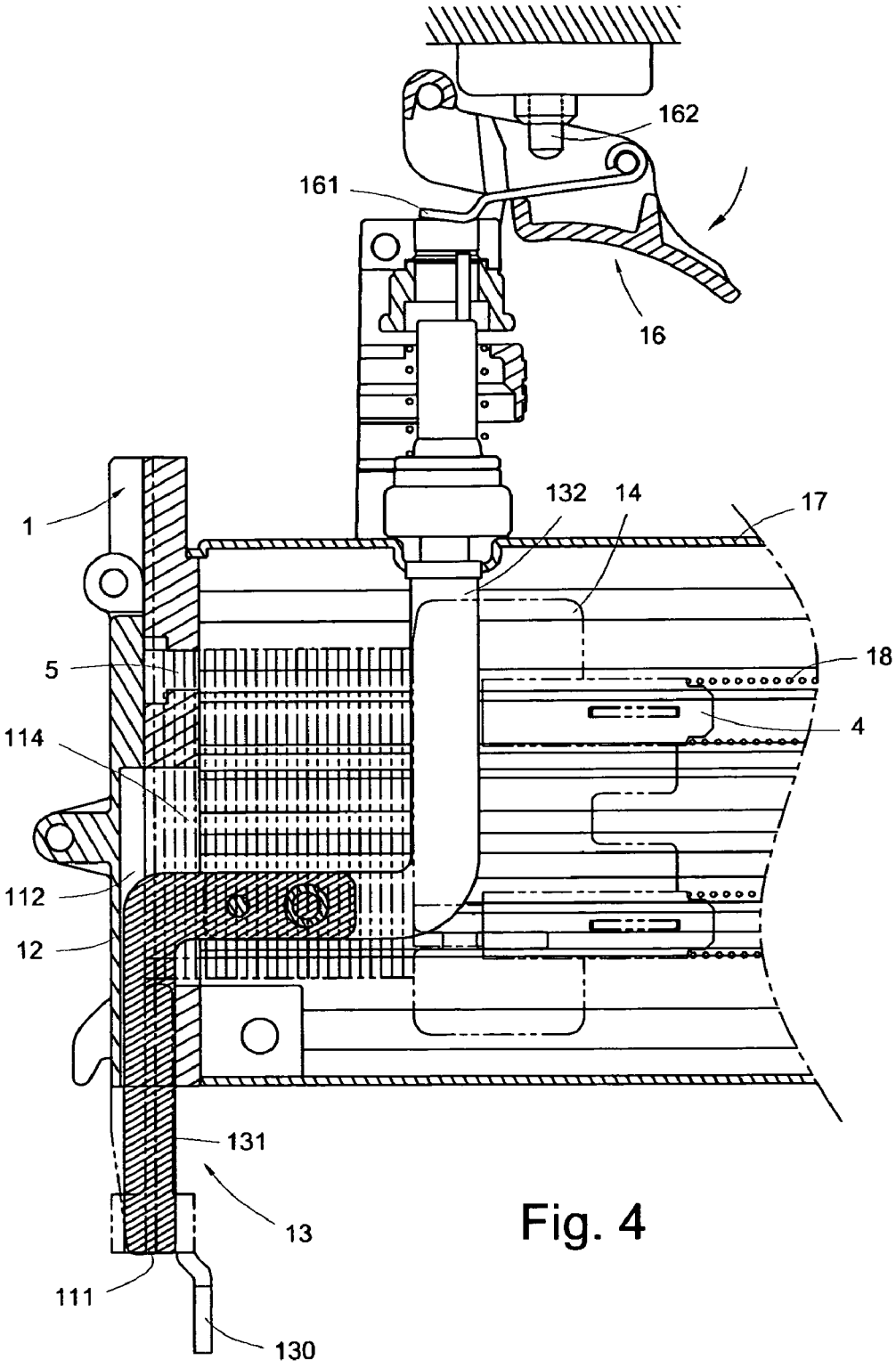
FIG. 4 is a cross sectional view along a line A—A of FIG. 3, showing the knocking section of the securing slide rod located within the guiding portion of the guiding plate.

The securing sliding rod 13 can slide with respect to the guiding plate 11 via the guiding portion 112 (as shown in FIGS. 2 and 4). The lower end of the securing sliding rod 13 forms a knocking head 130 capable of extending out of the punch channel 111 (as shown in FIG. 4), and the upper end of the securing sliding rod 13 extends out of the nail cartridge 17 to be capable of reaching to a position so that an inner trigger 161 is pushed on to control a trigger stem 162 to actuate the nail driver 1.

Figure 5:
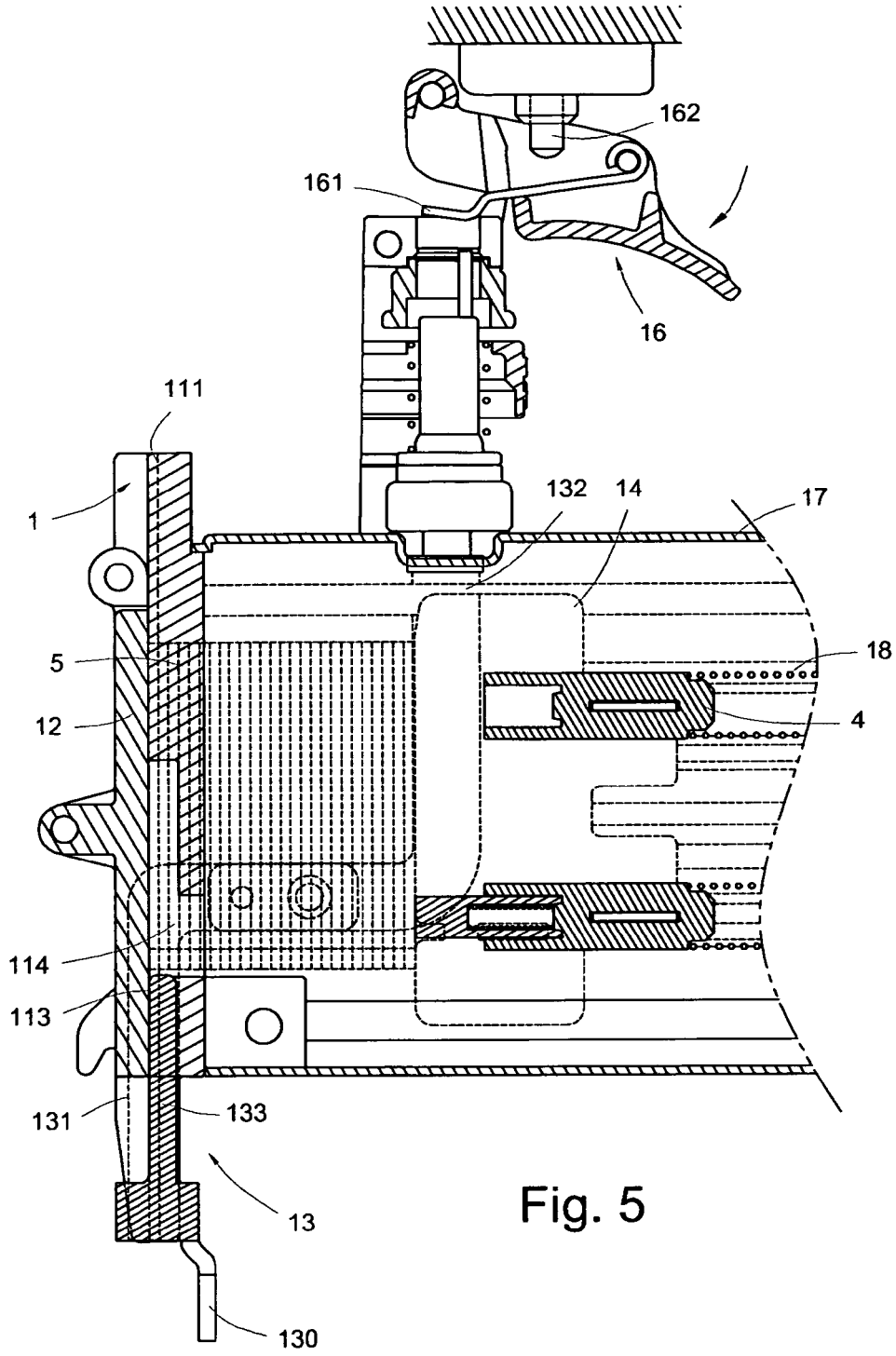
FIG. 5 is a cross sectional view along a line B—B of FIG. 3, showing the contact section of the securing slide rod located within the groove of the guiding plate.

Furthermore, the securing sliding rod 13 includes a knocking section 131, a pushing section 132 and a contact section 133. The knocking section 131 is located within the guiding portion 112 and the contact section 133 is located within the groove 113. As such, the knocking head 130, which protrudes from the knocking section 131 and the contact section 133, can extend out of the punch channel 111, and the pushing section 132 can raise to the position to have the inner trigger 161 being pushed (as shown in FIGS. 2, 4 and 5).

The nail pusher 14 is combined with a holder 4. A slit 141 is formed on the nail pusher 14. A spring 18 installed in the nail cartridge 17 is contacted to the bottom end of the holder 4 so that the nail pusher 14 can be pushed to press the T-shaped nails 5 toward the punch channel 111 (as shown in FIG. 5). The holder 4 has an inner space 41 for receiving the braking unit 2 (as shown in FIG. 2).

The braking unit 2 is driven by the resilient element 3. The braking unit 2 includes a protrusion 21, a hook 22 and a slot 23. The hook 22 is located within the slit 141 of the nail pusher 14 to make the braking unit 2 have stable movement with respect to the nail pusher 14 (as shown in FIG. 2).

The resilient element 3 can be a spiral spring or other equivalent components to drive the braking unit 2 to move. One end of the resilient element 3 is positioned in the slot 23 of the braking unit 2, therefore, the other end of the resilient element 3 will be positioned in the inner space 41 of the holder 4 when the braking unit 2 is received in the inner space 41.

According to the assembly of the above-mentioned components, the nail driver 1 of the present invention can provide a braking mechanism to restrain the movement of a securing slide rod 13 when all nails are gone.

Figure 6:
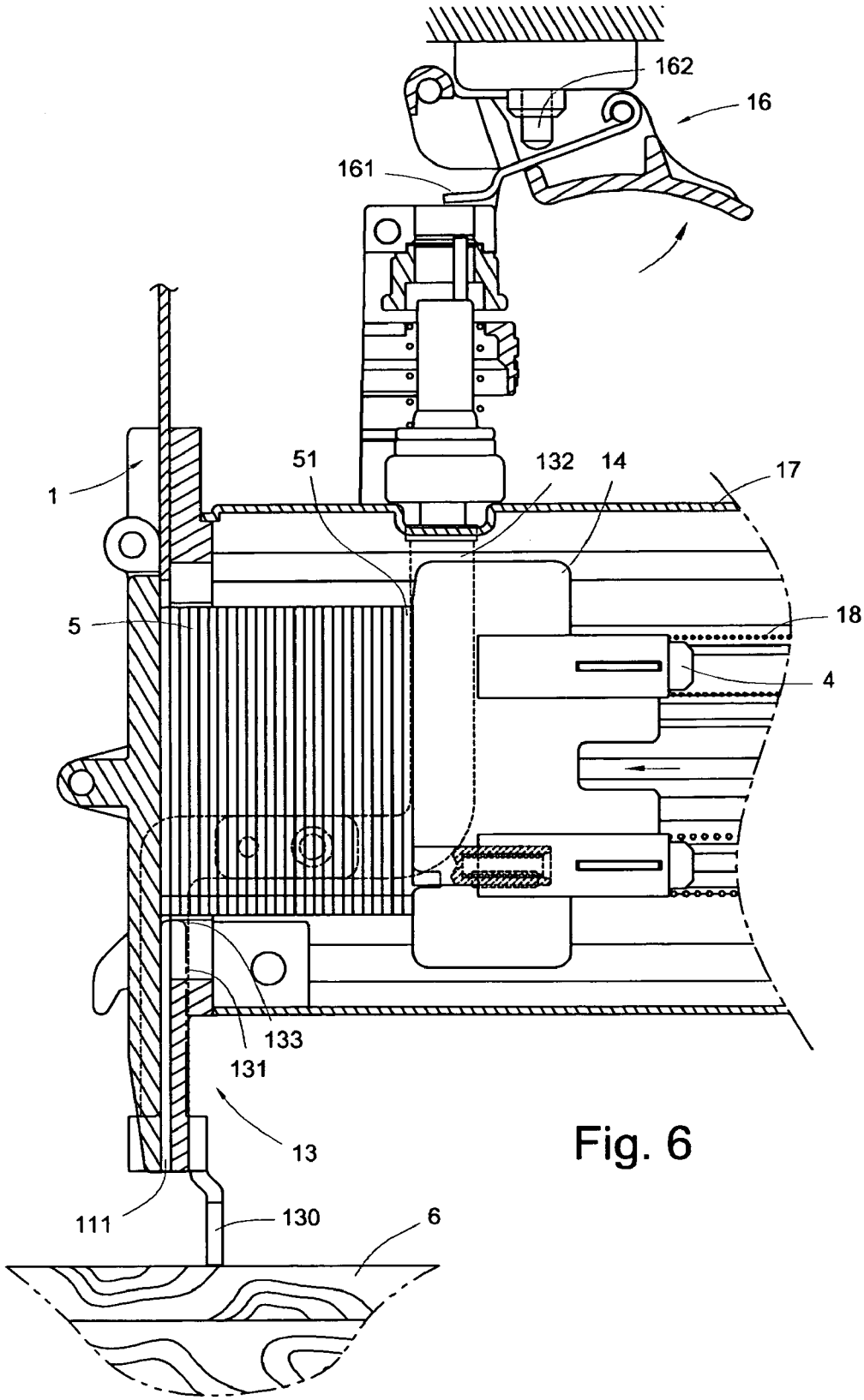
FIG. 6 is a cross sectional view along a line C—C of FIG. 3, showing the loaded nails being pushed toward the punch channel of the guiding plate by the nail pusher.
Figure 7:
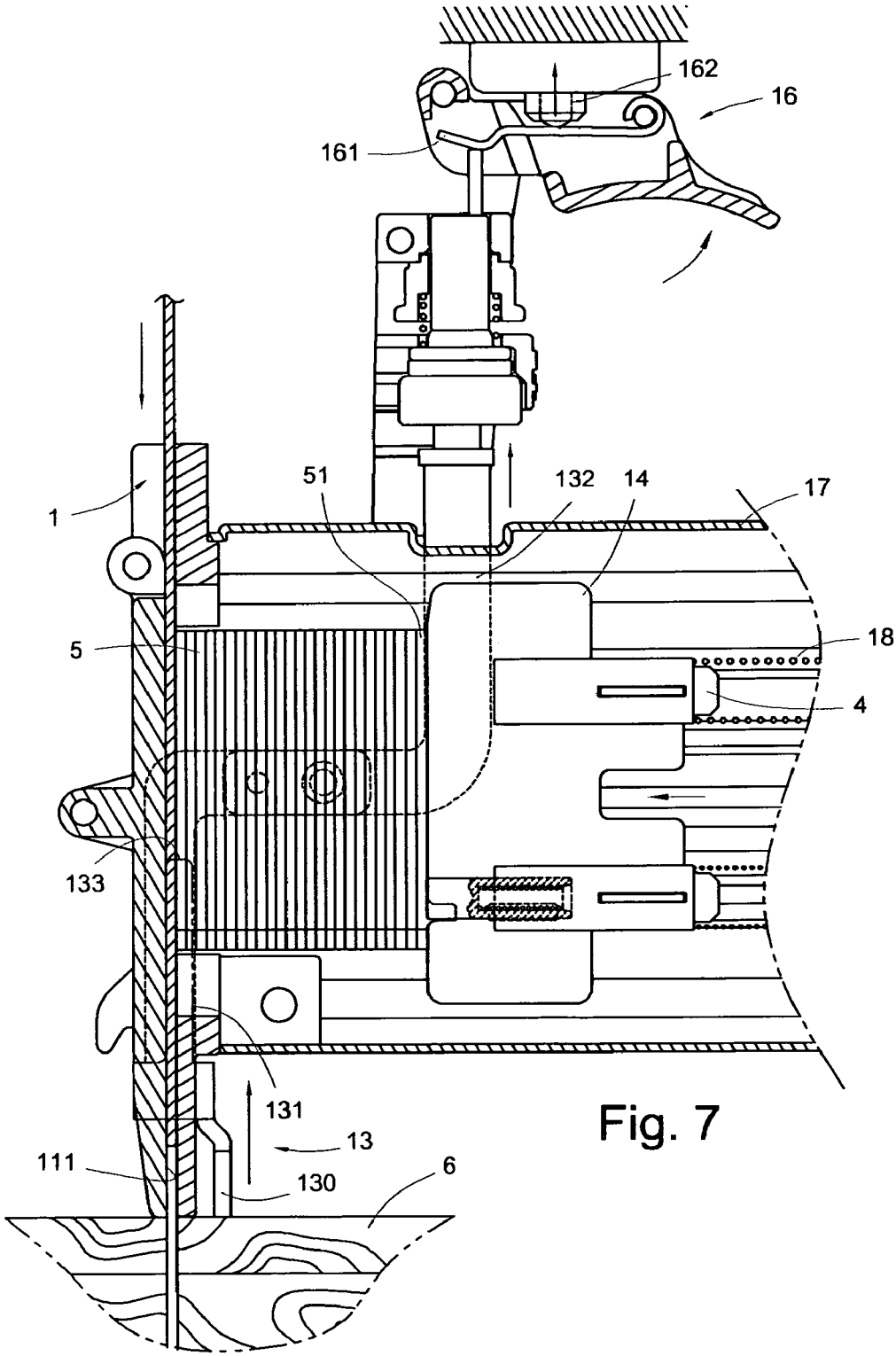
FIG. 7 shows the knocking head pressing against the surface of the workpiece and the securing slide rod rising upward so that the inner trigger pushed on to control the trigger stem to actuate the nail driver.

As shown in FIGS. 2 and 6, when there are still nails 5 existed in the nail cartridge 17 and a nail left in the punch channel 111, the nail pusher 14 together with the protrusion 21 of the braking unit 2 will press on the last nail 51. In this situation, a user can presses the knocking head 130 against a surface of a workpiece 6 to have the inner trigger 161 being pushed on due to the pushing section 132 of securing sliding rod 13 raising upward (as shown in FIG. 7). The securing slide rod 13 can smoothly slide up and down because the knocking section 131 and the contact section 133 are properly guided by the guiding portion 112 and the groove 113, respectively (as shown in Figure). Therefore, under a trigger 16 is activated, the trigger stem 162 is pressed down by the inner trigger 161, and the punch rod 15 is forced to strike the nail 5 for shooting.

Figure 8:
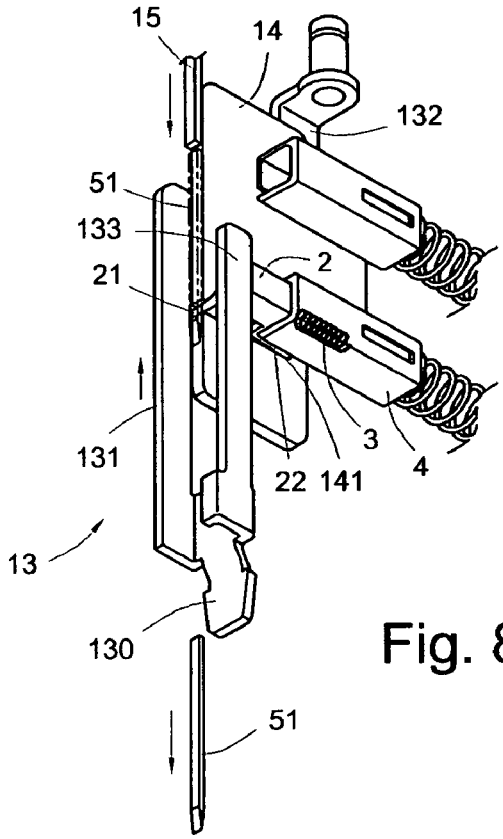
FIG. 8 shows the protrusion of the braking unit together with the nail pusher pushing on the last nail.
Figure 9:
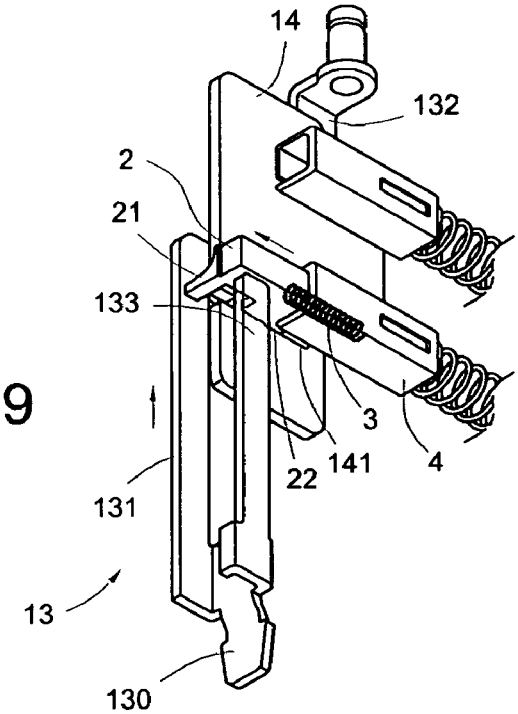
FIG. 9 shows the braking unit being pushed by the resilient member to block the movement of the contact section.
Figure 10:
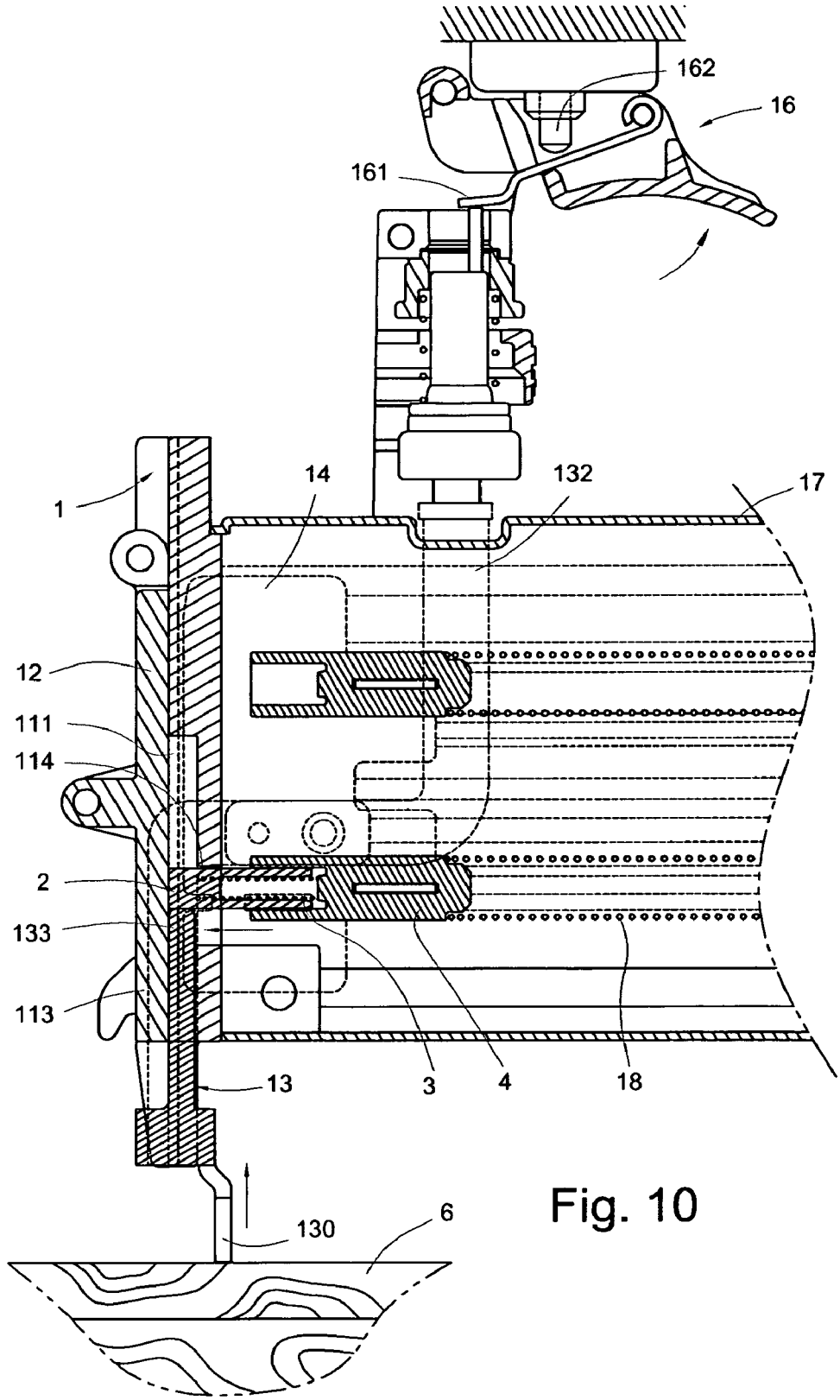
FIG. 10 shows the braking unit being pushed to the groove to block the securing slide rod moving upward.

As the last nail 51 loaded in the punch channel 111 is shot (as shown in FIG. 8), that is, no more nail 5 left in the nail driver 1, the nail pusher 14 directly pushes on the guide plate 12; however, the braking unit 2 is further pushed by the resilient element 3 to move forward until the protrusion 21 is located in the passage 114 and the braking unit 2 is blocked in the groove 113 (as shown in FIGS. 9 and 10). As such, the braking unit 2 stops the movement of the contact section 133. That is, the securing slide rod 13 cannot slide upward by pressing on the knocking head 130 to have the inner trigger 16 pushed on so that even the trigger 16 is activated, the trigger stem 162 is not pressed down by the inner trigger 161; therefore, the nail driver 1 cannot be activated any more. It is to remind the user to reinstall the nails in the nail cartridge 17. Accordingly, the braking unit 2 can help the user to detect if there is any nail existed in the punch channel 111. It ensures the nail driver will not be actuated when the nail driver runs out of nails.

Figure 11:
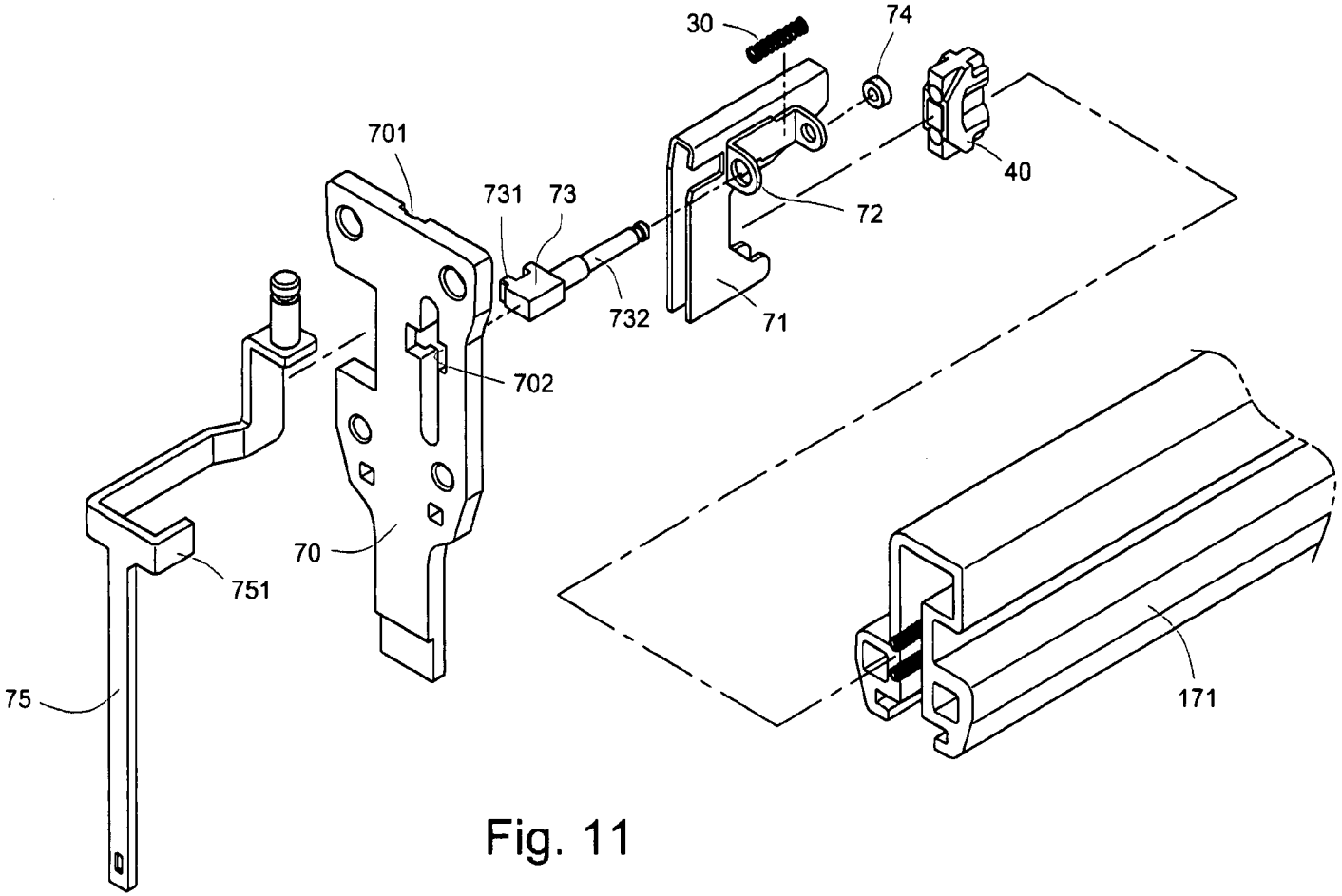
FIG. 11 is an exploded perspective view of a nail driver according the second preferred embodiment of the present invention, showing the holder mounted on the nail pusher.

Furthermore, referring to FIG. 11, according the second preferred embodiment of the present invention, a nail driver performing reversed U-shaped nails includes a nail pusher 71 moveably installed in a nail cartridge 171 and a braking unit 73 and an resilient element 30 mounted on the nail pusher 71. A securing slide rod 75 is mounted to a guiding plate 70. The guiding plate 70 includes a punch channel 701 and a groove 702. The nail pusher 71 can includes a retainer 40 so that a spring installed in the nail cartridge 171 can push on the retainer to have the nail pusher 71 press the nails toward the punch channel 701.

Figure 12:
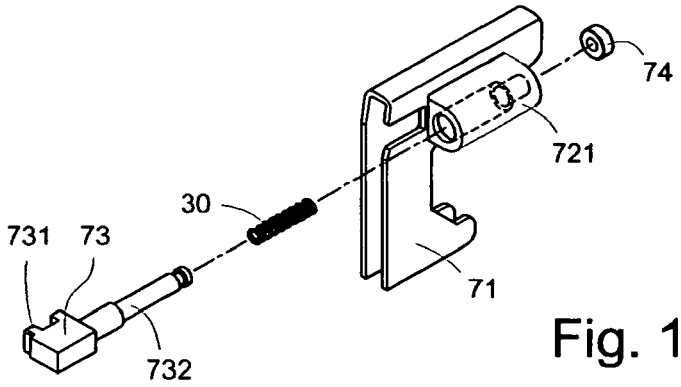
FIG. 12 shows another example of the holder to be used.

A holder 72 is mounted on the nail pusher 71 for receiving the braking unit 73. The braking unit 73 includes a cuboid portion for securely restrain the movement of the securing slide rod 75, a protrusion 731 formed on the cuboid portion and a telescopic rod portion 732 to be received in the holder 72 with the resilient element 30 installed thereon. In another embodiment, as shown in FIG. 12, a telescopic inner space 721 corresponding the telescopic rod portion 732 of the holder 72 is formed. A ring 74 can be provided to lock on the distal end of the telescopic rod portion 732 of the braking unit 73. Therefore, The braking unit 73 will not be disconnected from the holder 72.

Figure 13:
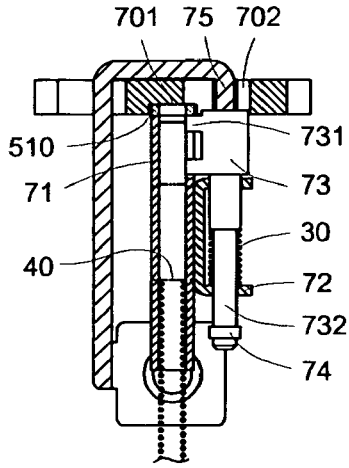
FIG. 13 shows the protrusion of the braking unit together with the nail pusher pushing on the last reversed U-shaped nail.
Figure 14:
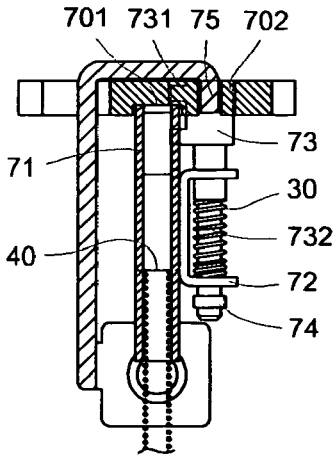
FIG. 14 shows the braking unit being pushed by the resilient member to block the movement of the contact section.

As shown in FIG. 13, when the last nail 510 exists in the punch channel 701 or more nails still exist in the nail cartridge 171, the nail pusher 71 together with the protrusion 731 of the braking unit 73 will press on the nail 510. At this situation, the braking unit 73 does not block the movement of a contact section 751 of the securing slide rod 75. Therefore, the nail driver can be actuated. However, as shown in FIG. 14, when the last nail 510 is shot, that is, no more nail left the nail driver, the nail pusher 71 directly pushes on the guide plate 70 and the braking unit 73 is further pushed by the resilient element 30 to move forward until the cuboid portion of the braking unit 73 is blocked in the groove 702. As such, the braking unit 73 stops the movement of the contact section 751 and the nail driver cannot be activated any more.

The present invention is thus described. It will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nail driver comprising:

a guiding plate including a punch channel;

a securing slide rod including a contact section, capable of slidably moving with respect to the guiding plate;

a nail cartridge mounted to the guiding plate, including a nail pusher and a spring for pushing the nail pusher to press nails loaded in the nail cartridge toward the punch channel;

a braking unit mounted on the nail pusher, including a protrusion to contact a last nail of the loaded nails; and a resilient member contacting to the braking unit and nail pusher for pushing the braking unit relative to the nail pusher into a blocking position to block movement of the contact section when the last nail is gone.

2. The nail driver as claimed in claim 1, wherein the securing slide rod further includes a knocking section capable of extending to press against a surface of a workpiece and a pushing section capable of raising to a position to cause an inner trigger of the nail driver and to be pushed.

3. The nail driver as claimed in claim 2, wherein the guiding plate includes a guiding portion and a groove, and the knocking section and the pushing section are movably located within the guiding portion and the groove, respectively.

4. The nail driver as claimed in claim 1, wherein the nail pusher includes a slit and the braking unit includes a hook moveably located within the slit.

5. The nail driver as claimed in claim 1, further comprising a holder mounted on the nail pusher, the spring installed in the nail cartridge and contacting a bottom end of the holder so that the nail pusher can be pushed to press the loaded nails toward the punch channel.

6. The nail driver as claimed in claim 5, wherein the braking unit includes a slot for receiving the resilient member, and the holder includes an inner space for receiving the braking unit and the resilient member.

7. The nail driver as claimed in claim 6, wherein the resilient element is a spiral spring.

8. The nail driver as claimed in claim 1, further comprising a holder mounted on the nail pusher, the braking unit including a telescopic rod portion for receiving the resilient member thereon.

9. The nail driver as claimed in claim 8, wherein the holder includes a telescopic inner space corresponding to the telescopic rod for receiving the braking unit and the resilient member.

* * * * *